US005426491A

United States Patent [19]

Landa et al.

[11] Patent Number: 5,426,491

[45] Date of Patent: Jun. 20, 1995

[54] METHOD AND APPARATUS FOR ENHANCING THE COHESIVENESS OF DEVELOPED IMAGES IN ELECTROSTATIC IMAGING PROCESSES

[75] Inventors: Benzion Landa, Edmonton, Canada; Yakov Krumberg, Rehovot, Israel; Yaacov Almog, Ramat Hasharon, Israel; Yehuda Niv, Rehovot, Israel

[73] Assignee: Indigo N.V., SM Veldhoven, Netherlands

[21] Appl. No.: 272,323

[22] Filed: Nov. 17, 1988

[51] Int. Cl.[6] ..... G03G 15/10

[52] U.S. Cl. ..... 355/256; 355/273; 355/279

[58] Field of Search ..... 355/256, 271, 273, 274, 355/277, 279

[56] References Cited

U.S. PATENT DOCUMENTS

| | | | |
|---|---|---|---|
| 3,851,964 | 12/1974 | Smith et al. | 355/280 |
| 4,015,027 | 3/1977 | Buchan et al. | 430/124 |
| 4,135,960 | 1/1979 | Shuppert et al. | 156/240 |
| 4,286,039 | 8/1981 | Landa et al. | 430/119 |
| 4,364,661 | 12/1982 | Landa | 355/274 |
| 4,411,976 | 10/1983 | Landa et al. | 430/114 |
| 4,453,820 | 6/1984 | Suzuki | 355/273 X |
| 4,461,823 | 7/1984 | Held | 430/120 |
| 4,675,268 | 6/1987 | Kishi et al. | 430/126 |
| 4,698,110 | 10/1987 | Vassilion | 156/231 |
| 4,708,460 | 12/1987 | Langdon | 355/271 |
| 4,839,673 | 6/1989 | Kegelman et al. | 355/276 X |

FOREIGN PATENT DOCUMENTS

| | | | |
|---|---|---|---|
| 55-147651 | 11/1980 | Japan | 355/273 |
| 56-167175 | 12/1981 | Japan | 355/273 |
| 59-55466 | 3/1984 | Japan | 355/273 |
| 2169416 | 7/1986 | United Kingdom . | |

*Primary Examiner*—Fred L. Braun

*Attorney, Agent, or Firm*—Sandler, Greenblum & Bernstein

[57] ABSTRACT

An imaging process including the steps of forming an electrostatic image on a photoconductor surface, developing the electrostatic image with a liquid developer to form a developed image on the photoconductor surface, and transferring the developed image from the photoconductor surface to a final substrate. The cohesiveness of the developed image on the photoconductor surface is enhanced by the application of heat, ultraviolet radiation or a catalytic agent to the developed image on the photoconductor surface.

27 Claims, 3 Drawing Sheets

METHOD AND APPARATUS FOR ENHANCING THE COHESIVENESS OF DEVELOPED IMAGES IN ELECTROSTATIC IMAGING PROCESSES

FIELD OF THE INVENTION

The present invention relates generally to imaging and specifically to treating images which have been developed with liquid toners, prior to transfer of such developed images to substrates.

BACKGROUND OF THE INVENTION

The present invention relates more particularly to electrostatic printing and copying, and especially to such processes utilizing liquid toners. The basic steps of the liquid toner imaging process are:

1. Generating an electrostatic latent image, e.g. on a photoconductive surface such as a plate or drum which has been sensitized by charging with a corona discharge and by exposure to light in the form of an image, the charge being dissipated in exposed areas.
2. Developing the latent image by contact with a liquid dispersion ("toner") of fine particles which are attracted to the charged areas, or to the uncharged areas in a reversal type development.
3. Removal of excess liquid toner and particles from the background areas.
4. Transfer of the image, e.g. to a substrate such as paper.
5. Fixing the image by fusing the particles together and to the substrate.
6. Cleaning the plate or drum for re-use.

In this connection reference is made to the following published patent applications and issued patents in the field of electrophotography: GB Published Patent Applications Nos. 2,169,416A and 2,176,904A, and U.S. Pat. Nos. 3,990,696, 4,233,381, 4,253,656, 4,256,820, 4,269,504, 4,278,884, 4,286,039, 4,302,093, 4,326,644, 4,326,792, 4,334,762, 4,350,333, 4,355,883, 4,362,297, 4,364,460, 4,364,657, 4,364,661, 4,368,881, 4,378,422, 4,392,742, 4,396,187, 4,400,079, 4,411,976, 4,412,383, 4,413,048, 4,418,903, 4,420,244, 4,435,068, 4,439,035, 4,454,215, 4,460,667, 4,473,865, 4,480,825, 4,501,486, 4,522,484, 4,531,824, 4,538,899, 4,582,774, 4,585,329, 4,586,810, 4,589,761, 4,598,992, 4,603,766, 4,620,699, 4,627,705 and 4,678,317, the contents of all of which are incorporated by reference herein.

While certain aspects of copy quality can be associated with the efficiency of each of the above-mentioned steps of the liquid toner based electrostatic imaging process, none of the above-referenced patent applications and issued patents discloses a method of improving copy quality by a pre-transfer treatment of a developed image.

Following development in liquid toner processes, excess toner and particles are removed from the image, by a step often referred to as "metering". This step may be carried out by use of an electrically biased reverse roller. At the transfer stage, there is likely to occur a degree of smudging, smearing or squashing of the image, which detracts from its quality. Furthermore, the entire image may not transfer completely to the carrier substrate, thus leaving a residue of toner on the surface from which the image was transferred. The quality of the transferred image also normally depends on the surface roughness of the substrate.

In Published UK Patent Application GB 2169416A (Landa et al), the contents of which are incorporated herein by reference, a degree of squash-resistance is imparted to the developed image by using fibrous toner particles prepared as follows: a thermoplastic polymer (and pigment) is plasticized with a nonpolar liquid, preferably at elevated temperature, to form a sponge, the sponge is shredded, more nonpolar liquid is added, the pieces of shredded sponge are wet-ground into particles and the grinding is continued to pull the particles apart to form fibers extending therefrom (the particles preferably having a diameter less than 5 microns). Finally, a charge director may be added to impart a charge of predetermined polarity to the toner particles.

While the method of the aforementioned Published UK Patent Application improves the transfer efficiency of the developed image and results in reduced residue on the surface in question, it would nevertheless be desirable to be able to provide an additional of alternative method for improving the transfer efficiency and to leave a negligible residue or even no residue on the surface from which the image is transferred. It is known to heat an image to melting on an intermediate transfer member, as shown, for example in U.S. Pat. No. 4,015,027. An intermediate transfer member is employed to avoid, inter alia, the undesirable alternative of heating the image on a photoconductor.

SUMMARY OF THE INVENTION

It is thus a principal object of the present invention to provide a method of treatment of a developed image in an electrostatic, magnetic or other imaging process, which improves the efficiency of transfer and reduces the amount of residue on the surface from which the developed image was transferred.

It is a further object of the invention to provide a method of treatment of a developed image in an electrostatic, magnetic or other imaging process, which improves the rigidity and cohesiveness of the image. An additional object of the invention is to provide a method which will afford high quality images on a wide variety of substrates.

There is thus provided in accordance with a preferred embodiment of the invention an imaging process which includes the steps of initially forming an image on a surface and subsequently transferring the image therefrom to a substrate, the improvement comprising the step of enhancing the cohesiveness of the image prior to the step of transfer thereof from the surface.

Further in accordance with a preferred embodiment of the invention there is provided an imaging process which includes the steps of initially forming an image on a surface and subsequently transferring the image therefrom to a substrate, the improvement comprising the step of causing the image to form an integral cohesive film prior to the step of transfer thereof from the surface to a substrate.

Additionally in accordance with a preferred embodiment of the invention there is provided an imaging process which includes the steps of initially forming an image on a surface and subsequently transferring the image therefrom to a substrate, the improvement comprising the step of causing the image to at least partially coalesce prior to a step of final transfer of the image to a final substrate.

In accordance with one embodiment of the invention, the step of subsequently transferring includes the steps of transferring the image from the surface to an intermediate transfer element and of transferring the image from the intermediate transfer element to the final substrate and the step of causing takes place when the image is on the intermediate transfer element.

Preferably the step of transferring includes the step of transferring the image as a unit rather than as separate toner particles onto a substrate.

Additionally in accordance with an embodiment of the invention there is provided an imaging process which includes the steps of:

initially forming an image on a surface;

at least partially fusing the image to produce a coalesced image without fixing the image to the surface;

transferring the coalesced image to a final substrate; and fusing the coalesced image on the final substrate for fixing of said image on the final substrate.

Additionally in accordance with a preferred embodiment of the invention the step of transferring comprises the steps of transferring the image from the surface to an intermediate transfer element and of transferring the image from the intermediate transfer element to the final substrate and wherein the step of at least partially fusing takes place when the image is on the intermediate transfer element.

Additionally in accordance with an embodiment of the invention there is provided for use in imaging apparatus comprising means for initially forming an image on a surface and subsequently transferring the image therefrom to a substrate, the improvement comprising:

apparatus for enhancing the cohesiveness of the image to transfer thereof from the surface.

Additionally in accordance with a preferred embodiment of the invention there is provided for use in imaging apparatus comprising means for initially forming an image on a surface and subsequently transferring the image therefrom to a substrate, the improvement comprising:

apparatus for causing the image to form an integral cohesive film prior to transfer of the image from the surface to a substrate.

Additionally in accordance with a preferred embodiment of the invention there is provided imaging apparatus including apparatus for initially forming an image on a surface and apparatus for subsequently transferring the image therefrom to a substrate, the improvement comprising:

apparatus for causing the image to at least partially coalesce prior to final transfer of the image to a final substrate.

The apparatus for subsequently transferring comprises means for transferring the image as a unit rather than as separate toner particles onto a substrate.

Additionally in accordance with a preferred embodiment of the invention there is provided imaging apparatus including:

apparatus for initially forming an image on a surface;

apparatus for at least partially fusing the image to produce a coalesced image without fixing the image to the surface;

apparatus for transferring the coalesced image to a final substrate; and apparatus for fusing the coalesced image on the final substrate for fixing of the image on the final substrate.

Enhanced cohesiveness may be caused by supplying an input of heat energy to the image prior to the step of transfer. The heat energy may be provided from at least one of the following sources:

an incandescent lamp;

infrared irradiation.

The image preferably comprises a pigmented polymeric binder containing residual reactive functions which are cross-linked by supply of heat energy thereto. The reactive functions may comprise ethylenic bonds which may be reacted with added ethylenic comonomer or oligomer.

Cross linking may be achieved by application of at least one of the following:

heat;

ultraviolet radiation;

catalysis.

The image may be initially formed by the following steps:

Forming an electrostatic latent image on the surface; and developing the latent image by contacting it with a liquid toner composition.

Additionally in accordance with a preferred embodiment of the invention, there is provided an image produced in an image process or using imaging apparatus described hereinabove.

BRIEF DESCRIPTION OF THE DRAWING

The present invention will be understood and appreciated more fully from the following detailed description, taken in conjunction with the drawing, in which.

DETAILED DESCRIPTION OF THE INVENTION

Figure 1:
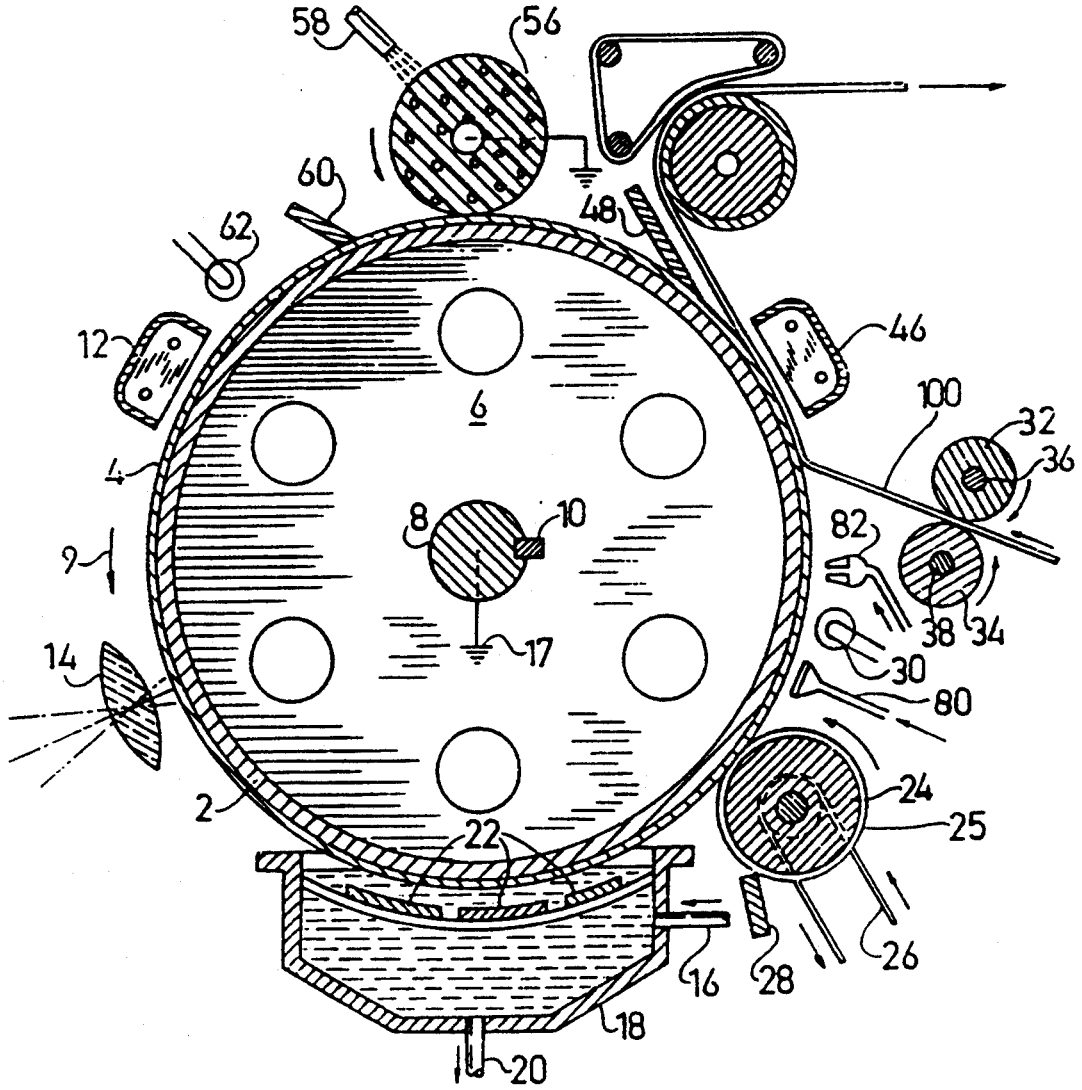
FIG. 1 illustrates schematically in section, apparatus suitable for carrying out the method of the invention.

The present invention lies in the field of imaging, including printing and copying. An exemplary electrostatic imaging process, namely an electrophotographic process using a liquid toner and incorporating the present invention, is described with reference to FIG. 1. Metal drum 2 carries a photoconductor 4 and is mounted by disks 6 on a shaft 8 to which the disks are secured by a key 10 so that the assembly, in a light-proof housing (not shown), will rotate with shaft 8. Shaft 8 is driven in any appropriate manner (not shown) in the direction of arrow 9 past a corona discharge device 12 adapted to charge the surface of photoconductor 4. The image to be reproduced is projected by a lens 14 upon the charged photoconductor. Since the shaft 8 is grounded at 17 and disks 6 are conductive, the areas struck by light will conduct the charge, or a portion thereof, to ground, thus forming an electrostatic latent image.

The developing liquid containing a dispersion of polymer-supported pigment in an insulating, nonpolar liquid, with added charge director, (as described herein), is circulated from any suitable source (not shown) through pipe 16 into a development tray 18 from which it is drawn through pipe 20 for recirculation. Development electrodes 22, which may be appropriately biased as known to the art, assist in toning the electrostatic latent image as it passes into contact with the developing liquid.

Charged toner particles, suspended in the carrier liquid, pass by electrophoresis to the electrostatic latent image. If the photoconductor is positively charged, for example, if a selenium photoconductor is used, then the pigment particles will be negatively charged. If, however, the photoconductor is negatively charged, for example, if a cadmium sulfide photoconductor is used, the pigment particles will be positively charged.

Since the amount of liquid on the photoconductor surface is normally too great for satisfactory subsequent transfer of the developed image, a roller 24, whose surface moves in a direction opposite to that of the photoconductor surface, is spaced from the photoconductor surface by a spacer 25, and is adapted to shear excess liquid from the developed image without disturbing it. An exemplary roller is shown in U.S. Pat. No. 3,907,423, the contents of which ape incorporated by reference herein.

Roller 24 is driven by any appropriate means, for example, by a drive belt 26 which is driven by any appropriate, known speed-controllable motor means (not shown), and is kept clean by a wiper blade 28. The developed image, which has been cleaned of excess liquid by roller 24, now encounters at least one of devices 80, 30 and 82, the respective functions of which are described below.

In accordance with the invention, the developed image is at this point treated in order that its cohesiveness may be irreversibly enhanced. In one embodiment, this treatment may consist of an input of energy, such as heat energy, to the developed image, preferably by means of infrared or other light irradiation from a lamp 30.

Heating of the image by radiation is particularly beneficial when the image bearing surface is generally non-absorbing of such radiation, such as when the photoconductive surface comprises selenium. In such a case, the image absorbs the radiant energy and is heated to a temperature above that to which the photoconductive surface, which does not absorb the radiant energy, is heated. As a result, relatively high image temperatures may be achieved without corresponding heating of the photoconductor. Preferably an infrared transmitting filter may be employed to filter out the visible radiation from an incandescent lamp which is the radiation source. However, as shown in Examples 1–7 below, the use of such a filter is not absolutely necessary.

When the developed image includes a polymeric binder containing residual reactive functions, then in an alternative embodiment of the invention, at least some of these reactive functions are cross-linked. In the case of residual ethylenic bonds, for example, the cross-linking may be effected by at least one means selected from the following, namely, heat, ultraviolet radiation and catalysis, and may be carried out by reaction with added ethylenic comonomer or oligomer. One manner of carrying out this embodiment would be to include added comonomer or oligomer in development tray 18; no cross-linking reaction with the polymer would occur until, for example, chemical catalyst in predetermined proportions is applied via a spray head 80, and/or ultraviolet radiation is applied from lamp 30, which is regarded here as a source of ultraviolet radiation rather than of infrared radiation as in the previously described embodiment, and/of heat is applied, as for example in the form of hot air via an air-jet device 82. This embodiment could also be carried out (for example) by adding cross-linking monomer or oligomer in predetermined amounts via spray head 80 to the developed image, and then effecting the cross-linking reaction by use of ultraviolet radiation from lamp 30 and/or heat in the form of hot air via air-jet device 82.

A pair of register rolls 32 and 34 is adapted to feed a carrier sheet 100, which is to receive the developed image, to the transfer station, where a corona discharge device 46 is adapted to impress upon the reap of the carrier sheet a charge of polarity opposite to that of the toner particles forming the image. The developed image is thus drawn towards the carrier sheet. Rolls 32 and 34 are mounted on and secured for rotation with axles 36 and 38, respectively.

A pickoff member 48 assists in the removal of the carrier sheet bearing the developed image from the photoconductor. The image is then fixed onto the carrier sheet 100, prior to delivery to an exit tray.

According to a preferred embodiment of the invention, a cleaning roller 56, formed of any appropriate synthetic resin, is driven, in a direction of rotation opposite to that of the photoconductor, to scrub the surface of the latter clean. To assist in this action, insulating, nonpolar, nontoxic liquid may be fed through pipe a 58 to the surface of the cleaning roller 56. A wiper blade 60 completes the cleaning of the photoconductive surface. Preferably, any residual charge left on the photoconductive drum is neutralized by flooding the photoconductor surface with light from a lamp 62.

The insulating, nonpolar, liquid used as the medium for toner particles as well as for other optional purposes as described herein, preferably has a resistivity in excess of about $10^9$ ohm-cm and a dielectric constant below about 3.0. Suitable such liquids are hydrocarbons, preferably aliphatic and more preferably isomerized aliphatic hydrocarbons, as, for example, those marketed by Exxon Corporation under such trade marks as ISOPAR-G, ISOPAR-H, ISOPAR-L and ISOPAR-M, which meet the preferred resistivity and dielectric requirements. Alternatively, other liquids having the preferred resistivity and dielectric requirements, e.g. light mineral oils, such as those manufactured by the Humble Oil and Refining Company under the trade marks MARCOL 52 and MARCOL 62, may be used.

Polymers useful as binders for the pigments may be thermoplastic. The presently preferred polymers are known under the trade mark ELVAX II, manufactured by E. I. Du Pont de Nemours & Company. The ELVAX II family are ethylene copolymers combining carboxylic acid functionality, high molecular weight and thermal stability.

The greater thermal stability and higher strength properties of ELVAX II resins are due to two factors. First, the presence of an alkyl group on the same carbon atom on the polymer chain to which is attached a carboxylic acid group increases the chain stiffness and the energy required for rotation of the polymer chain. Second, the presence of hydrogen bonding establishes a resonance-stabilized configuration.

The presently preferred ELVAX II resins are those designated 5720 and 5610. Other polymers which may be used are the ELVAX polymers, as well as the ethylene/ethyl acrylate series made by Union Carbide such as those designated DPD 6169, DPDA 6182 Natural and DTDA 9169 Natural. Still other useful polymers made by Union Carbide are those designated DQDA 6479 Natural 7 and DQDA 6832 Natural 7; these are ethylene/vinyl acetate resins.

The pigment may be present generally in an amount of 3–60% by weight with respect to the weight of the polymer. Suitable proportions in any particular case may be readily determined by one of ordinary skill in the art. Illustrative examples of potentially suitable pigments are Cabot Mogul L (black), Monastral Blue G (C.I. Pigment Blue 15 C.I. No. 74160), Quindo Magenta (Pigment Red 122), Indo Brilliant Scarlet Toner (Pigment Red 123, C.I. No. 71145), Dalamar Yellow (Pigment Yellow 74, C.I. No. 11741), blue pigment BT-383D (DuPont), yellow pigment YT-717D (DuPont), red pigment RT-455D (DuPont) and blue pigment Helioecht Blue G0 (Bayer). The pigment may be, if desired, a finely ground ferromagnetic material, e.g. Mapico Black. Other suitable materials are metals including iron, cobalt, nickel and various magnetic oxides including $Fe_2O_3$ and $Fe_3O_4$; and others known in the art. Mixtures of known magnetic materials may also be used.

The liquid toner composition may be prepared (e.g.) by initially mixing a suitable polymer, together with plasticizer and selected pigment(s), until homogeneity is achieved. Thereafter, the mixture is allowed to cool while mixing is continued. The mixing temperature may range from about 65° to about 100° C. preferably about 90° C. Mixing times prior to cooling, typically about 90 minutes, may range between about 10 minutes and 3 hours. Any suitable mixing or blending device may be employed, such as the Ross double planetary mixer (manufactured by Charles Ross & Son of Hauppauge, N.Y.).

After the mixture has been cooled, it is charged to an attritor, disk mill, sand mill, impeller attrition mill, vibroenergy mill, or the like. The grinding is not necessary only to reduce the particle size of the constituents of the toner composition, but also, for example, to pull the larger particles apart and, in so doing, to form desired fibers on the polymeric toner particles, in order to improve the cohesion of the particles forming the developed image and to better enable it to resist "squash." An important feature of the method described herein for preparing the toner composition is to wet-grind the composition. The liquid used during the grinding operation may be, e.g., ISOPAR-H, which is present in an amount of 70–90% by weight with respect to the polymer. During the grinding, the particle size is determined, for example, by centrifugal analysis using, e.g., a Horiba Centrifugal Particle Size Analyzer, Model CAPA 500, manufactured by Horiba Instruments Inc. of Irvine, Calif.

The ground material is then dispersed, e.g., in ISOPAR-H and mixed with a charge director to form a working dispersion having a solids content of about 0.5 to about 3% by weight. The amount of charge director is dependent on its characteristics and the requirements of the use of the particular toner in question.

Illustrative charge directors are, e.g., magnesium, calcium and barium petronates; aluminum stearate; manganese naphthenate; metal dialkylsulfosuccinates; zirconium octoate; other metal soaps such as copper oleate; and lecithin.

Any other suitable toner material which solvates at a relatively low temperature may alternatively be used. Examples of such materials appear in U.S. Pat. No. 4,411,976, the disclosure of which is incorporated herein by reference.

It is to be emphasized that the present invention is not to be construed as limited to the embodiments particularly described, which relate to development with liquid toner, especially such toner which contains pigment associated with a polymeric binder (possibly fibrous), e.g. such toner containing a charge director. As will be evident to persons skilled in the art, the present method may also be applied to a liquid developed image where a charge director is not used and/or the pigment support is not polymeric and/or the pigment support is polymeric but not fibrous and/or the liquid toner medium is other than herein defined and particularly described.

A preferred embodiment of the present invention provides a method of treating the developed image in electrostatic imaging so that it undergoes an irreversible change. According to a preferred embodiment of the invention the overall effect of this treatment is to form a film.

The method of the invention may be practiced by a physical treatment and/or a chemical treatment. While the method of the invention is not to be limited by any theory, nevertheless it would seem likely that in the case of a physical treatment, the edges of the thermoplastic polymer binder particles coalesce with the edges of adjoining similar particles.

Where the method of the invention includes a chemical treatment, then it would appear likely that chemical bonds are formed, inter alia, between similar adjoining polymer binder particles, or between such adjoining polymer particles and a "bridge" molecule, for example, in the form of added comonomer or oligomer. Thus, it will be appreciated that the developed image as formed on the photoconductor (desirably subject to preliminary removal of fluffiness and at least some solvent) will be in a sense "frozen", or fixed, and will be less liable to smudging, smearing or squashing as in the prior art, and that it will thus be more susceptible to being transferred whole to a substrate (and without leaving any significant residue on the photoconductor), than in the case of the known art.

Most substrates, even those relatively smooth to touch, appear under the microscope as uneven, and as a series of "hills" and "valleys". In the prior art electrostatic imaging processes, the developed image would tend to be transferred only to the "hills", so that in many substrates there would be voids in the image corresponding to the "valleys".

Because, as a result of the present invention, the image is transferred as a whole, the problem just described is very much less likely to arise and a variety of substrates including, for example, rough substrates such as textiles, as well as, e.g., bond papers, may therefore be utilized.

It will be understood that the "hills" and "valleys" constitute micro-variations in the surface of the substrate. The problem described in the preceding paragraphs has a tendency to produce an image having reduced density. The present invention seeks to avoid the phenomenon of undesirably reduced density.

The invention will now be illustrated by the following non-limitative examples:

EXAMPLES 1–7

The pre-transfer treatment of the invention was carried out in a Savin 870 copier, having only the following modifications: a 1000 watt tungsten-halogen incandescent lamp was installed between the reverse roller and the transfer station; different heat energies were achieved by variation of the lamp power supply: the drum/filament distance was 15 mm.; and the width of the output slit of the lamp housing was 8 mm. The results were as follows:

| Example No. | Paper Type | Heat Energy (Joules/cm$^2$) | Transfer Voltage (kV) | S.A.D. (invention) | S.A.D. (untreated) |
|---|---|---|---|---|---|
| 1 | Gilbert Bond 25% cotton | 0.66 | 8.0 | 1.62 | 1.40 |
| 2 | Kimberly Writing 25% cotton fiber | 0.66 | 7.2 | 1.65 | 1.38 |
| 3 | Trojan Bond 25% cotton fiber | 0.585 | 6.8 | 1.59 | 0.9 |
| 4 | Old Council Tree Bond | 0.628 | 7.0 | 1.60 | 1.25 |
| 5 | Classic Laid | 0.596 | 7.0 | 1.62 | 1.10 |
| 6 | Savin 2200+ | 0.585 | 6.7 | 1.67 | 1.35 |
| 7 | Xerox 4024 | 0.58 | 6.7 | 1.66 | 1.35 |

S.A.D. = solid area optical density

The results in this table show a notable improvement in the optical density, after the treatment in accordance with the invention, whichever kinds of paper were used. By contrast, the (lower) optical densities obtained in the comparison runs depended to a great extent on the particular kind of paper used.

The toner used in Examples 1–7 was prepared as follows:

(a) Toner pre-mix—1000 g. Elvax II 5720 resin (DuPont) and 500 g. Isopar L were mixed in a Ross double planetary mixer for 1 hour at 90° C., then for a further hour after addition of 250 g. Mogul L carbon black (Cabot) which had been wetted by 500 g. Isopar L, and finally for another hour after addition of 2000 g. Isopar L pre-heated to 110° C. Stirring was continued in absence of heating until the temperature reached 40° C. 3050 g. of the resultant mixture was milled in a Sweco M-18 vibratory mill (containing 0.5" alumina cylinders) with 4000 g. Isopar L for 20 hours at 40° C.; the average particle size of the product was 2.5 microns.

(b) Toner working dispersion—177 g. of the product of part (a) was diluted with 1323 g. Isopar H to form a 1.5% solids content working dispersion, and mixed with 7 ml. of 10% lecithin solution in Isopar H (Fisher Scientific Co.).

Figure 3:
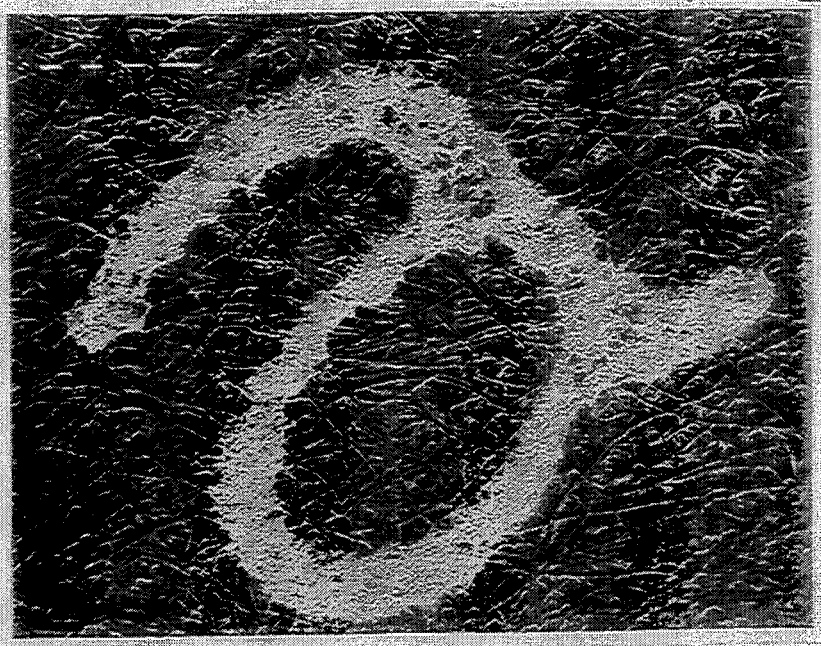
FIG. 3 (PRIOR ART)
FIGS. 2 and 3 are photomicrographs illustrating the use of the invention.
Figure 2:
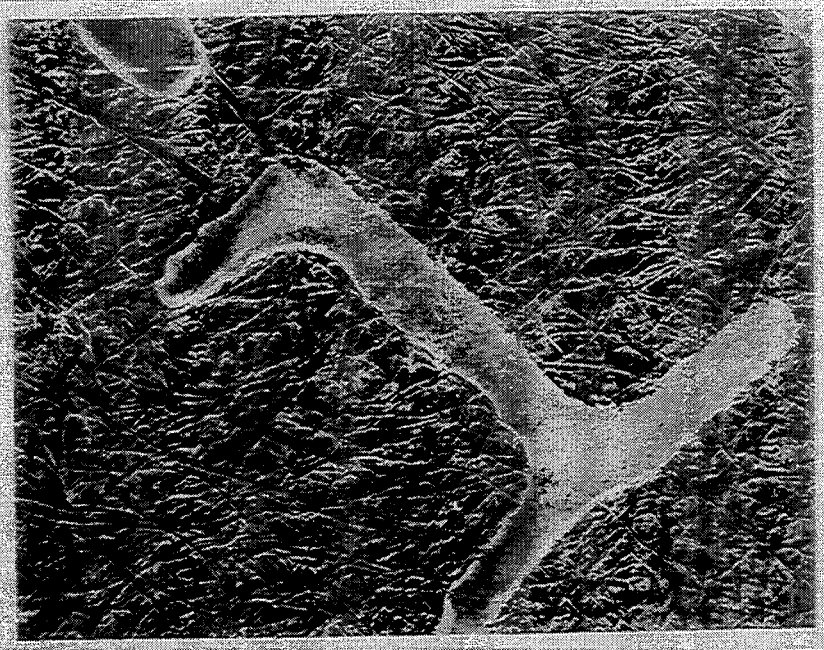

FIGS. 2 and 3 are photomicrographs which illustrate the present invention. FIG. 2 is a 50×enlargement of a letter transferred using the toner described in the preceding paragraphs in accordance with Example No. 6 and FIG. 3 is a photograph at the same photomicrograph at the same magnification of toner transfer without pre-treatment of the image prior to transfer in accordance with the present invention. It should be noted that both of the images shown in FIGS. 2 and 3 were printed at the same time using identical apparatus. Both images are shown prior to final fusing.

It should be noted that the image in FIG. 2 is in the form of an integral cohesive film, while, in contrast, the image of FIG. 3 appears particulate.

The invention may be understood as providing a preliminary of partial fusing step prior to transfer of the image onto the final substrate. By virtue of this preliminary fusing step, the toner particles coalesce to form a skin which is subsequently transferred to the final substrate as a unit rather than as separate particles. Following such transfer, conventional fusing techniques may be applied to fix the image onto the final substrate.

The paper used (Savin 2200+) is considered to be a relatively smooth paper. Nevertheless the effect of the invention is dramatic. Using the invention, as seen in FIG. 2, the percentage and uniformity of area coverage is significantly increased as compared the prior art, represented by FIG. 3, producing increased optical density.

It will be appreciated that the preliminary fusing step whereby the toner particles coalesce to form a skin which is subsequently transferred to the final substrate need not be carried out on the image forming surface, such as a photoconductor but may instead be carried out on an intermediate transfer member to which the image is transferred from the image forming surface and prior to transfer thereof to the final substrate.

Figure 4:
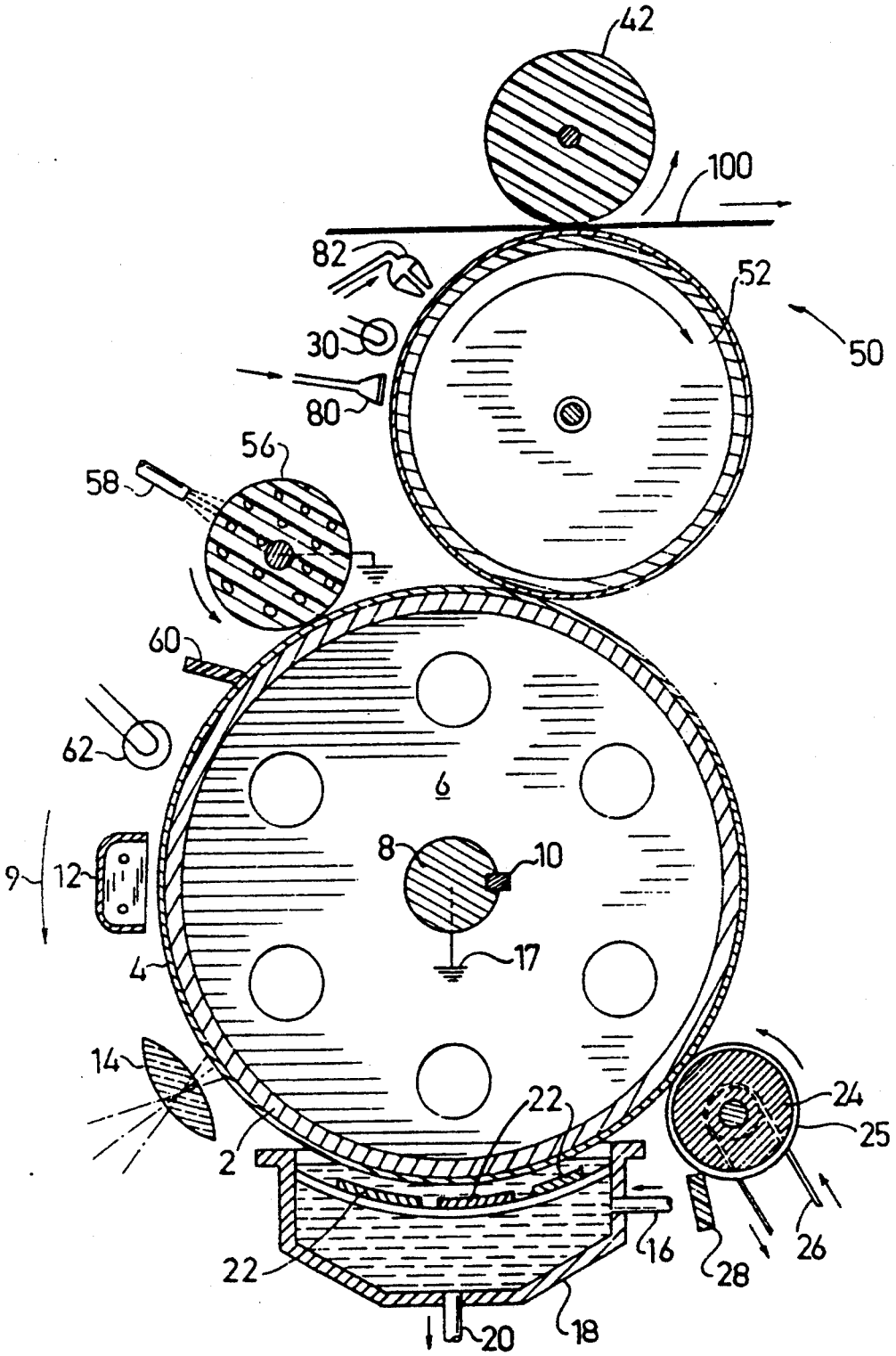
FIG. 4 illustrates a further embodiment of the present invention utilizing an intermediate transfer assembly.

Reference is now made to FIG. 4 which illustrates the use of an intermediate transfer assembly 50 for transfer of the image from the photoconductor 4, following metering by metering roller 24, to a carrier sheet 100. The remainder of the apparatus shown in FIG. 4 may be generally the same as that illustrated in FIG. 1. Components having the same function in both Figures are identified by an identical reference numeral.

The intermediate transfer assembly 50 comprises an intermediate transfer element 52, typically in the form of a cylindrical roller. Transfer of the image from the photoconductor 4 to the intermediate transfer element 52 may take place in accordance with any suitable technique known in the art, but preferably is electrophoretic transfer. Other suitable transfer techniques include electrostatic transfer, heat transfer, pressure transfer and combinations of the foregoing.

Following transfer of the image from the photoconductor 4 to the intermediate transfer element 52, the image is subjected to any of the coalescing techniques of the present invention as described hereinabove with reference to FIGS. 1–3 and in the Examples which appear hereinbelow.

The image is then transferred to the carrier sheet 100 in accordance with any suitable transfer technique which is known in the art, including, for example, electrostatic transfer, heat transfer, pressure transfer or any combination thereof. Preferably the image is transferred by electrostatic transfer.

EXAMPLE 8

A mixture of 5.5 g. carbon black (Mogul L, Cabot), 21.9 g. Elvax II 5720 (DuPont), 28 g. Sartomer 454 (Arco) and 65.9 g. Isopar L is heated at 80° C. until complete homogenization was achieved and then allowed to cool to room temperature. The mixture was transferred to an S—O attritor and 100 g. Isopar L was added. The mixture was ground for 24 hours to form toner particles and 14 ml. of 10% solution of lecithin in Isopar H (Fisher) was added. The material was then passed through an electrostatic separator in order to remove unbound Sartomer 454. The amount of Sartomer 454 remaining bound to the toner particles was 365 mg./g. of imaging material. The electrostatically treated toner material contained 27% nonvolatile solids (n.v.s.) and was diluted to 10% n.v.s. with Isopar L which contained Irgacure 651 (Ciba-Geigy) at a final concentration of 73 mg./g. of imaging material. The 10% n.v.s. toner was irradiated by a U.V. lamp. A change in the viscosity of the toner was observed and a cured film was detected. Scanning electron microscope photomicrographs showed a cohesive film formed by attachment of individual toner particles to one another.

While the invention has been particularly described with respect to certain embodiments, it will be appreciated by the person skilled in the art that many modifications and variations may be made. Specifically it is noted that the present invention is not limited to single color imaging, but is equally applicable to imaging employing an intermediate transfer member for multiple image transfer onto a substrate, wherein the multiple images may be of different colors. The invention is therefore not to be regarded as limited to such embodiments, which are merely illustrative. Rather, the invention is defined only in accordance with the claims which follow:

We claim:

1. An imaging process comprising the steps of:
developing an electrostatic image on a photoreceptor surface to form a developed image comprising a polymeric binder containing reactive functions;
causing cross-linking of at least some of said reactive functions.

2. An imaging process according to claim 1 wherein said reactive functions comprise ethylenic bonds and wherein said ethylenic bonds are reacted with added ethylenic comonomer or oligomer.

3. An imaging process according to claim 1 wherein said cross-linking is effected by at least one of the following:
heat
ultraviolet radiation;
catalysis.

4. An imaging process according to claim 1 wherein said step of cross linking takes place while the developed image is on the photoreceptor surface.

5. An imaging process according to claim 1 including the steps of:
initially transferring said developed image to an intermediate transfer member before the step of cross-linking; and
subsequently transferring said developed image from the intermediate transfer member after said step of cross-linking.

6. An imaging process according to claim 1 wherein said image is a liquid toner image.

7. An imaging process comprising the steps of:
forming an electrostatic image on a photoconductor surface;
developing said electrostatic image with a liquid developer to form a developed image on said photoconductor surface;
enhancing the cohesiveness of said developed image on said photoconductor surface by the application of ultraviolet radiation or a catalytic agent to said developed image; and
transferring the developed image from said photoconductor surface to a final substrate.

8. An imaging process which comprises the steps of initially forming an image comprising toner particles on a photoconductor surface and subsequently transferring the image therefrom to a substrate, the improvement comprising the step of causing the toner particles to at least partially coalesce prior to transfer of said image from said photoconductor surface; and
wherein said image is a liquid toner image comprising a polymeric binder containing reactive functions and said step of causing comprises cross-linking at least some of said reactive functions.

9. An imaging process according to claim 8 wherein said reactive functions comprise ethylenic bonds and wherein said ethylenic bonds are reacted with added ethylenic comonomer or oligomer.

10. An imaging process according to claim 8 wherein said cross-linking is effected by at least one of the following:
heat;
ultraviolet radiation;
catalysis.

11. An imaging process comprising the steps of:
forming an image on an electrostatic imaging surface;
at least partially fusing the image to produce a coalesced image without fixing the image to said surface;
transferring the image to a final substrate; and
wherein said image is a liquid toner image comprising a polymeric binder containing reactive functions and said step of at least partially fusing comprises cross-linking at least some of said reactive functions.

12. An imaging process according to claim 11 wherein said reactive functions comprise ethylenic bonds and wherein said ethylenic bonds are reacted with added ethylenic comonomer or oligomer.

13. An imaging process according to claim 11 wherein said cross-linking is effected by at least one of the following:
heat;
ultraviolet radiation;
catalysis.

14. An imaging process comprising the steps of:
forming an electrostatic image on an imaging surface;
developing the electrostatic to form a developed liquid toner image including toner particles on the imaging surface;
causing mutual cohesion Of the toner particles in the liquid toner image on the imaging surface;
subsequently transferring the image to a final substrate; and
wherein the step of causing includes the application of ultraviolet radiation to the toner image.

15. An imaging process comprising the steps of:
forming an electrostatic image on an imaging surface;
developing the electrostatic image to form a developed liquid toner image including toner particles on the imaging surface;
causing mutual cohesion of the toner particles in the liquid toner image on the imaging surface; and
subsequently transferring the image to a final substrate; and
wherein the step of causing includes the application of a catalytic agent to the toner image.

16. Imaging apparatus comprising:
means for developing an electrostatic image on a surface to form a developed image comprising a polymeric binder containing reactive functions; and
means for cross-linking of at least some of said reactive functions.

17. Imaging apparatus according to claim 16 wherein said reactive functions comprise ethylenic bonds and wherein said ethylenic bonds are reacted with added ethylenic comonomer or oligomer.

18. Imaging apparatus according to claim 16 wherein said cross-linking is effected by at least one of the following:
heat ultraviolet radiation;
catalysis.

19. Imaging apparatus according to claim 16 wherein means for of cross linking is operative on the image while the image is on the photoreceptor surface.

20. Imaging apparatus according to claim 16 and also comprising:

an intermediate transfer member;

first transfer means for transferring said developed image to an intermediate transfer member before cross-linking; and second transfer means for transferring said developed image from the intermediate transfer member after cross-linking.

21. Apparatus according to claim 16 wherein said image is a liquid toner image.

22. Imaging apparatus comprising means for initially forming an image comprising toner particles on a photoconductor surface and means for subsequently transferring the image therefrom to a substrate, the improvement comprising means for causing the toner particles to at least partially coalesce prior to transfer of said image from said photoconductor surface; and wherein said image is a liquid toner image comprising a polymeric binder containing reactive functions and said means for causing is operative to cause cross-linking at least some of said reactive functions.

23. Imaging apparatus according to claim 22 wherein said reactive functions comprise ethylenic bonds and wherein said ethylenic bonds are reacted with added ethylenic comonomer or oligomer.

24. Imaging apparatus according to claim 22 wherein said means for causing comprises at least one of the following:

heat;
ultraviolet radiation;
catalysis.

25. Imaging apparatus comprising:

image forming means for forming an electrostatic image on a photoconductor surface;

developing means for developing said electrostatic image with a liquid developer to form a developed image on said photoconductor surface;

enhancement means for enhancing the cohesiveness of said developed image on said photoconductor surface by the application of ultraviolet radiation or a catalytic agent to said developed image; and transfer means for transferring the developed image from said photoconductor surface to a final substrate.

26. Imaging apparatus comprising:

image forming means for forming an image on an electrostatic imaging surface;

first fusing means for at least partially fusing the image to produce a coalesced image without fixing the image to said surface;

image transfer means for transferring the to a final substrate; and wherein said image is a liquid toner image comprising a polymeric binder containing reactive functions and said fusing means is operative for cross-linking at least some of said reactive functions.

27. Imaging apparatus according to claim 26 wherein said cross-linking is effected by at least one of the following:

heat;
ultraviolet radiation;
catalysis.

* * * * *